United States Patent [19]

Honeyman et al.

[11] Patent Number: 4,585,495

[45] Date of Patent: Apr. 29, 1986

[54] STABLE NITRATE/SLURRY EXPLOSIVES

[75] Inventors: Gordon R. Honeyman, North Bay, Canada; James H. Owen, II, Jefferson City, Mo.

[73] Assignees: Du Pont of Canada, Inc., Mississauga, Canada; E. I. Du Pont de Nemours & Company, Wilmington, Del.

[21] Appl. No.: 710,542

[22] Filed: Mar. 11, 1985

[51] Int. Cl.[4] ..... C06B 45/00

[52] U.S. Cl. ..... 149/2; 149/21; 149/60; 149/38; 149/40; 149/41; 149/43; 149/44; 149/61; 149/62; 149/109.6

[58] Field of Search ..... 149/109.6, 2, 21, 60, 149/38, 40, 41, 43, 44, 61, 62

[56] References Cited

U.S. PATENT DOCUMENTS 4,380,482 4/1983 Sandell ..... 149/21

*Primary Examiner*—Stephen J. Lechert, Jr.

[57] ABSTRACT

Explosives that are sensitized blends of inorganic nitrate, e.g., AN, particles, such as AN or ANFO prills, and an aqueous slurry comprising a thickened aqueous solution of an inorganic oxidizing salt, preferably AN, are rendered storage-stable by keeping the slurry's water content low enough, and its viscosity high enough, that the slurry is water-retentive. Water immobilization in the slurry, a requirement for storage stability, is achieved despite the slurry's flowable consistency at the time of blending. A blend containing about 25% slurry or less, is essentially in the form of a granular mass of free-flowing, high-density, slurry-bearing prills, and the slurry is sensitizable by the prills alone. As the slurry content exceeds about 25%, the blend takes on the characteristics of a thick slurry, requiring a supplemental sensitizer in the slurry per se. Slurries containing a nitrogen-base salt of an inorganic oxidizing acid, preferably monomethylamine nitrate, are preferred because this additive affords a saturated solution with lower water content, and also can act as a sensitizer.

16 Claims, No Drawings

STABLE NITRATE/SLURRY EXPLOSIVES

BACKGROUND OF THE INVENTION

1. Field of the Invention

The present invention relates to explosive compositions comprising a sensitized blend of a fuel- and oxidizer-containing aqueous slurry and solid particulate inorganic nitrate, preferably ammonium nitrate (AN), in the form of prills or granules which may be coated with fuel oil (e.g., ANFO).

2. Description of the Prior Art

Ammonium nitrate (AN), an essential ingredient in nearly all commercial explosives, is used predominantly in the form of prills which are small porous pellets mixed with fuel oil and are commonly referred to as ANFO. ANFO products have found extensive use in a wide variety of blasting applications because of economy and convenience. However, because of its low water-resistance, the use of ANFO in bulk form in water-filled boreholes necessitates the de-watering of the holes and lining them with plastic. Moreover, because of its low bulk density, the energy produced from ANFO per unit of volume is low.

In recent years, explosives which comprise a blend of AN prills and a water-in-oil emulsion have captured the interest of blasters owing to the fact that they are able to offer the advantages of high bulk density, blasting energy, and water resistance characteristic of emulsion explosives, while at the same time resulting in cost reductions owing to the lower cost of the AN. Stable explosives of this type are described in U.S. Pat. No. 4,555,278 granted to L. A. Cescon and N. J. Mellet, Jr.

Another type of product which has been recognized as being capable of increasing the bulk density and blasting energy of AN prills when blended therewith is the well-known type known as "slurries" or water gels. These products comprise an inorganic oxidizing salt, usually AN, dissolved, and generally also suspended, in a thickened continuous aqueous phase which also contains one or more fuels and sensitizers. However desirable the possibilities that slurry/prill blends might appear to offer, however, they heretofore have not been well-accepted because of the tendency of the prills to soften and deteriorate into fines, a condition which not only in effect eliminates the presence of the prills as a discrete phase in the blend, but ultimately may destroy the integrity of the slurry structure itself so that the blend is no longer an effective explosive. In prill blends, a discrete prill phase is important on several counts, including better handling characteristics in certain slurry/prill ratios, improved sensitivity, etc.

The above-described prill deterioration problem heretofore has been attacked in various ways. One way has been to package the slurry and ANFO, with a water-proof barrier between the two. For example, U.S. Pat. No. 3,342,132, issued Sept. 19, 1967, to D. S. Partridge, describes a packaged product wherein ANFO, sealed in a polyethylene bag, is placed inside a larger film package containing an aqueous slurry explosive, which surrounds the ANFO package. This patent also describes making waterproof prills according to U.S. Pat. No. 3,148,095, distributing the waterproof prills in an aqueous slurry mixture, and packaging. In this case, the prills are first impregnated with paraffin and then coated with gilsonite and wax. This technique of producing a stable slurry/prill product is disadvantageous because of the added expense of the multiple prill coatings required, and also because it seals in the prill's pores with paraffin, thereby destroying the well-known sensitizing capability of the voids in the prills and yielding a low-density product.

The solution to the problem of prill attack in slurry/prill blends adopted by R. B. Clay in U.S. Pat. No. 4,294,633, issued Oct. 13, 1981, is to avoid aqueous slurries entirely, and to use, instead, slurries based on polar organic liquids, i.e., methanol and ethylene glycol.

In the foregoing patents, slurry/prill blends are made by mixing the prills with with a pre-formed thickened slurry, i.e., a thickened slurry which already contains the AN that is to be present in dissolved form in the product. Such products are true "blends" in the strict sense of the word, inasmuch as they are formed by mixing two components which undergo essentially no compositional change during the mixing. As made, the products contain discrete, well-defined prills in an amount essentially equal to the amount used to form the blend. These products differ from the prill-containing slurries which result from slurry/preparation processes wherein AN, in the form of prills, is added to an aqueous medium for the purpose of producing a saturated solution or liquor. In these products the content, if any, in intact, discrete prills is unpredictable, and hence difficult to control, because of solution-crystallization processes that occur. According to U.S. Pat. No. 3,630,250, issued Dec. 28, 1971, to J. R. Hradel, particulate ammonium nitrate is admixed with water to produce a paste-like (compositions containing 3–12% water) to pumpable (compositions containing 12–25% water) composition containing both dissolved and solid-phase AN. The AN, water, and a particulate metal sensitizer are specifically described as being mixed together by kneading in a plastic bag.

U.S. Pat. No. 4,213,809, issued July 22, 1980, to N. E. Gehrig, describes making an extrudable water gel blasting agent by adding solid AN to an aqueous medium in two steps, both before the hydration of a thickening agent therein occurs. After thickening, a crosslinking agent is added to produce the extrudable gel having the consistency of a thick grout or mortar. The finished product contains a total of 75–85% AN and 10–13% water.

A need exists for products which are sensitized blends formed by combining AN prills, or other inorganic nitrate particulate materials, and fuel- and oxidizer-containing aqueous slurries. More particularly, a need exists for aqueous slurry/prill blends which are stable with respect to prill deterioration when the prills have no waterproof coating.

SUMMARY OF THE INVENTION

The present invention provides a storage-stable explosive composition comprising a sensitized blend formed by combining inorganic nitrate, preferably ammonium nitrate (AN), particles, e.g., AN or ANFO prills, and an aqueous slurry comprising a thickened aqueous solution of an inorganic oxidizing salt, preferably AN or AN in combination with sodium nitrate (SN), the water content and viscosity of the slurry used to form the blend being restricted so as to make the slurry at once flowable and water-retentive, and the slurry constituting about from 5 to 60 percent, and the nitrate particles about from 95 to 40 percent, of the blend by weight.

It has been found that instability in nitrate/slurry blends is caused, in part, by the transference of water to the nitrate particles from the aqueous slurry that directly surrounds them. In the blends of this invention, water transference is minimized, and storage-stability achieved, because of the water-retentive character of the slurry per se, in contrast to the film barriers and waterproof prill coatings heretofore required.

A slurry which is water-retentive in the storage-stable composition of the invention can be recognized by applying the following test:

A 30-milliliter cup having a 45-mm top diameter, a 30-mm bottom diameter, and a height of 35 mm is filled to its brim with the slurry, and a No. 4 Whatman filter paper is placed directly over the slurry, concentrically with the cup axis. The assembly is inverted onto a level surface, and allowed to stand for 24 hours at 25° C. with a 100-gram weight on the upwardly directed cup bottom to assure good contact between the slurry and the paper. The degree of liquid penetration into the paper from the slurry after 24 hours at 25° C., i.e., the distance between the outer cup edge and the outer edge of the ring of liquid formed in the paper around the cup by absorption (an inverse measurement of water retentiveness) is measured and, in the slurry used in the present product, is found to be less than 6.35 cm.

It will be understood that the flowability characteristic of the slurry, a requirement for blendability, is that which exists at the time of blend formation, and does not necessarily define the nature of the slurry in the finished blend. Water-retentiveness, on the other hand, a requirement for the blend's storage stability, is a characteristic of the pre-blended as well as the blended slurry.

The term "blend" as used herein to describe the explosive composition of the invention denotes a product which is formed by mixing or otherwise combining the nitrate particles and the pre-formed slurry component of the composition. The slurry component in the present composition, having been pre-formed, is already thickened and contains the amount of dissolved inorganic oxidizing salt required therein, and thus this composition is distinguishable from those products of unpredictable prill content which result when AN prills are used to form an aqueous liquor during slurry formation.

The term "storage-stable explosive composition" as used herein to describe the present product denotes a composition which detonates at a velocity of at least about 3000 meters per second in a 10-cm diameter when initiated with a 0.45-kg cast primer after one month or more of storage.

Despite the fact that the slurry component of the blended product of this invention is flowable, at least at the time of blending, its water is in a relatively immobilized state therein by virtue of the slurry's low water content, in most instances no more than about 17, and preferably no more than about 13, percent by weight; and controlled viscosity, i.e., in the range of about from 80 to 3000 poise at the time of blending, as measured with a Brookfield viscometer at 25° C. using a No. 6 spindle at 20 rpm. Viscosities in this range afford slurries which are water-retentive yet still sufficiently flowable for blending.

A preferred composition of the invention is one in which the slurry component contains a dissolved nitrogen-base salt of an inorganic oxidizing acid, preferably an amine nitrate such as monomethylamine nitrate (MMAN). These salts, because of their high degree of solubility in water, afford stable saturated solutions with lower water content, and also can act as sensitizers for the slurry.

DETAILED DESCRIPTION

The present invention is based on the discovery that certain aqueous slurries comprising thickened aqueous solutions of inorganic oxidizing salts which have a flowable consistency, e.g., ungelled (i.e., uncrosslinked), or only lightly gelled, slurries or sols, can in fact be rendered water-retentive (i.e., have their water immobilized) to such degree that prill blends made therewith are storage-stable explosive products. Slurries which are to be blended with prills must be flowable, e.g., pourable, at the time of blending, and, because of this flowable character, would not be expected to exhibit water-retentiveness as would firm, but not blendable, rubber-like gels.

The need for water-retentiveness in thickened aqueous slurries used in blends with inorganic nitrate particles such as prills derives from the fact that in these blends the particles find themselves suspended in, or otherwise directly in contact with, the aqueous salt solution which, in slurries, is a continuous phase. This physical structure differs from that which is found in blends of inorganic nitrate particles and water-in-oil emulsions, wherein the aqueous salt solution is a discontinuous phase dispersed in a continuous phase of oil.

In the product of the present invention, the water-retentive character of the slurry upon which the storage stability of the blend depends requires that the slurry's water content be restricted, i.e., confined within certain bounds. The slurry's water content preferably is no greater than about 17 percent by weight, although under certain circumstances, as in the case of supersaturated all-AN slurries, the water content could be slightly higher, as will be explained below.

The oxidizer component of the slurry, which usually constitutes at least about 20 percent of the weight of the slurry, consists of one or more of the inorganic oxidizing salts commonly employed in water-bearing explosives, e.g., ammonium, alkali metal, and alkaline-earth metal nitrates and perchlorates. Specific examples of such salts are ammonium nitrate (AN), ammonium perchlorate, sodium nitrate (SN), sodium perchlorate, potassium nitrate, potassium perchlorate, magnesium nitrate, magnesium perchlorate, and calcium nitrate (CN). A preferred oxidizer component consists of AN, most preferably in combination with up to about 50 percent SN (based on the total weight of inorganic oxidizing salts), which affords a more concentrated liquor. Preferably, the concentration of the oxidizing salt(s) in the aqueous liquor is as high as possible, e.g., about from 40 to 70 percent by weight at room temperature. Some of the oxidizer component may be present as a dispersed solid, e.g., as a result of precipitation from a supersaturated liquor.

Desirably, the slurry used to form the storage-stable blend that constitutes the product of this invention is itself a storage-stable product. A storage-stable slurry, and especially one which is stable at ambient conditions, offers the advantage of ease of handling and wider utility inasmuch as it can be used to make blends at all locations where the inorganic nitrate particles, e.g., ANFO prills, are available, including those where slurry-making facilities are lacking. In the case of AN slurries, an effective way of achieving good storage characteristics is to include in the formulation one or more oxidizing salts which are more highly soluble in water than AN. Such salts include organic salts such as nitrogen-base salts of inorganic oxidizing acids, preferably amine nitrates and most preferably nitrates of 1–3 carbon aliphatic amines, e.g., monomethylamine nitrate (MMAN) and ethylenediamine dinitrate. Inorganic salts such as calcium nitrate also may be used as the highly soluble additive salt. The amine nitrates are preferred additives because they are more soluble than calcium nitrate and also because they are chemical sensitizers for the slurry, thereby enhancing the detonability of the blend. Calcium nitrate also is less preferred because its use requires careful pH control to avoid the rapid cross-linking of commonly used thickeners, which effect could produce a non-flowable slurry.

Because of the higher degree of solubility of the above-described soluble salts, especially MMAN, less water is required to produce a storage-stable slurry wherein the salt solution is saturated at ambient conditions. Because of the low water content of the slurry and the hydration of the thickener therein, the slurry exhibits the water-retentive character upon which the storage stability of the blend depends. In these stable-slurry systems, the water content of the slurry should not exceed about 17 percent by weight, and preferably should be in the range of about from 9 to 13 percent, this range resulting in the longest-term retention of the loadability and detonability properties required in the blend. While a water content as low as about 5 percent by weight is feasible, 9 percent is a more practical minimum based on solubility limitations.

Slurries containing no highly soluble salt additive, e.g., all-AN slurries, also can be used in making the blend product of this invention. In this case the slurry's water content usually will be slightly higher, e.g., up to about 25 percent by weight, and the slurry will be prepared at a temperature which is sufficiently high to produce a supersaturated AN solution. The blend made from this supersaturated slurry also is stable by virtue of the slurry's water-retentive character, but only under selected conditions of storage.

The slurry used in the present blends contains sufficient fuel to essentially oxygen-balance the blend, taking into consideration the total oxidizing salt(s) present in the slurry; the inorganic nitrate, e.g., AN, particles in the blend; and any fuel which is carried by the particles, e.g., the fuel oil in ANFO prills. "Essentially oxygen-balance" means that the blend has an oxygen balance more positive than about −25 percent, and preferably in the range of about from −10 to +10 percent. In preferred blends, the inorganic nitrate particles are ANFO prills (AN prills lightly coated with fuel oil), in which the usual AN/FO weight ratio is about 94/6. In these blends, the fuel in the slurry is sufficient to essentially oxygen-balance the slurry per se, inasmuch as the ANFO prills are already oxygen-balanced. When fuel-free or fuel-deficient nitrate particles are used to make the blend, the additional fuel needed to oxygen-balance the nitrate particles may be incorporated in the slurry per se or may be co-blended with the nitrate particles and slurry.

Fuel components for water-bearing explosives containing an inorganic oxidizing salt component are well-known in the art, and any of these may be present in the slurry component of the blend products of this invention. Non-explosive fuels include sulfur and carbonaceous fuels such as finely divided coal, gilsonite, and other forms of finely divided carbon; solid carbonaceous vegetable products such as cornstarch, wood pulp, sugar, ivory nut meal, and bagasse; and hydrocarbons such as fuel oil, paraffin wax, and rubber. In general, carbonaceous fuels may constitute up to about 25, and preferably about from 1 to 20, percent of the weight of the slurry.

Metallic fuels which may be present in the slurry include finely divided aluminum, iron, and alloys of such metals, e.g., aluminum-magnesium alloys, ferrosilicon, and ferrophosphorus, as well as mixtures of such metals and alloys. The quantity of metallic fuels varies markedly with the particular fuel employed and can constitute up to about 50 percent of the total weight of the slurry. With finely divided aluminum, for example, about from 1 to 20 percent by weight usually is used; although up to about 40 percent may be used in special cases. With heavier metallic fuels such as ferrophosphorus and ferrosilicon, about from 10 to 30 percent usually is employed.

Water-insoluble self-explosive particles such as trinitrotoluene, pentaerythritol tetranitrate, cyclotrimethylenetrinitramine, and mixtures thereof can be used as fuels in the slurry, while acting as sensitizers as well. However, it is preferred that the fuel and/or sensitizer components of the slurry used in the blend products of this invention contain, instead of water-insoluble explosives, water-soluble explosives and preferably nitric or perchloric acid salts derived from amines, including the nitrates and perchlorates of aliphatic amines, most preferably lower-alkyl, i.e., 1–3 carbon, amines such as methylamine, ethylamine, and ethylenediamine; alkanolamines such as ethanolamine and propanolamine; aromatic amines such as aniline; and heterocyclic amines such as hexamethylenetetramine. On the basis of availability and cost, nitric acid salts of lower-alkyl amines and alkanolamines are most preferred. As was mentioned previously, the presence of amine nitrates in the slurry is desirable also because of their high degree of solubility in water, thereby permitting the formation of low-water-content slurries which are storage-stable at ambient conditions.

Flake, or pigment-grade, aluminum also may be present in the sensitizer component of the slurry.

The water-retentive and flowable character of the slurry used in the blend product of the invention requires that the slurry's viscosity also be restricted, i.e., confined within certain bounds. The slurry's viscosity is essentially a function of its water content and of the type and amount of hydratable thickener present, as well as the amount of any solids suspended therein. More hydratable thickeners, such as guar gum, and higher thickener concentrations, by increasing the concentration of water-reactive centers, produce a more water-retentive slurry and a longer "shelf-life". For a given thickener, the amount used should be sufficient to provide a slurry viscosity, at the time of blending, of at least about 80 poise to assure a degree of water-retentiveness adequate for blend storage-stability. A viscosity of at least about 500 poise is preferred to assure an even higher degree of water-retentiveness. Also, the amount of thickener used should be small enough that the slurry viscosity at the time of blending, does not exceed about 3000 poise, and preferably does not exceed about 2500 poise, to provide blendability. Usually about from 0.2 to 10 percent of the thickener is used, based on the weight of the slurry.

Representative thickeners which may be used include polysaccharides, usually a gum or derivatized cellulose.

Galactomannans constitute one of the industrially important classes of gums which can be employed, and locust bean gum and guar gum are the most important members of this class. Of these, natural and derivatized guar gums are preferred. Modified guar gums, such as hydroxypropyl-modified guar, are useful in that they act a emulsifying as well as thickening agents, whereby fuel oil in the slurry becomes suspended in the slurry as the discontinuous phase of an oil-in-water emulsion. Other thickeners which can be employed include starches and modified starches such as dextrins, polyvinyl alcohol, polyacrylamides, high-molecular-weight polyethylene oxides; and mixtures of two or more of the specified thickeners.

As was stated previously, the water content of the slurry used in making the blend usually should be in the range of about from 5 to 17, and preferably about from 9 to 13, percent by weight, although in some systems slightly higher amounts may be acceptable. Whether or not a selected slurry water content within this specified range will result in a storage-stable blend, however, depends on the slurry content of the blend and the slurry viscosity. Slurries having a water content near the upper end of the recited range (e.g., about from 17–25%) are more effective when used in blends wherein the slurry/nitrate ratio is low, e.g., those containing no more than about 20–25% slurry. Also, most products, and especially those containing slurries having a water content near the upper end of the range, can be improved by adding a crosslinking agent for the thickener during the blending operation. The higher viscosity caused by the post-blending crosslinking of the thickener (a) will not interfere with the flowability requirement because flowability of the slurry component is unnecessary after blending; and (b) actually is beneficial because it will cause the overall blend structure to become relatively fixed. A fixed blend structure is helpful if one considers possible mechanisms of blend instability. For example, if an oiled prill, e.g., ANFO, in the blend were to be attacked by water exuding from the slurry, oil would be expected to separate from the prill partly because of displacement by water and partly because of prill dissolution. However, with a blend structure which is fixed owing to crosslinking, any oil separation which might occur is less capable of causing the blend to lose its explosive properties because the separated oil essentially would be fixed in place in close proximity to the prills, thereby preventing its gross separation into layers and the formation of a heterogeneous structure which could lead to product failure owing to the lack of sufficient dispersion and mixture of the oxidizer and fuel components.

The crosslinked structure is preferred, especially in blends containing slurries having a water content near the upper end of the above-recited range, e.g., a water content greater than about 13 percent. Because this structure retains the homogeneity of the blend, it minimizes the possibility of failure due to gross oil separation and stratification in ANFO-containing blends and allows the use of water concentrations at the upper end of the specified range when desired. Crosslinked systems also are desirable in that the growth of any inorganic nitrate particles that may have crystallized out of solution in the slurry will be inhibited, thus minimizing the chances that a large mass of agglomerated nitrate particles will form, a condition which also could lead to product failure.

Crosslinking agents for galactomannan gums are well-known, and include borax (U.S. Pat. No. 3,072,509), antimony and bismuth compounds (U.S. Pat. No. 3,202,556), and chromates (U.S. Pat. No. 3,445,305). An alkali metal dichromate either alone or in combination with a soluble antimony compound is often used, as is potassium pyroantimonate.

Blends containing slurries which are gelled (i.e., crosslinked) can be made from slurries which are in the lightly pre-crosslinked form (i.e., before blending), but preferably are made by allowing the thickener in the slurry to become crosslinked during and after blending, e.g., by adding a crosslinking agent either prior to blending, or to the partially blended slurry and inorganic nitrate particles. For example, after the slurry and particles have been blended for a few minutes, the crosslinker (solution or slurry) can be added, and blending continued to disperse the crosslinker. Thereafter, the blend can be delivered into packages or large containers until needed.

Blend sensitivity, i.e., the ability of the blend to be detonated after storage, is provided by a sensitized slurry and/or by porous AN prills. A composition of the invention which contains about 75 percent or more of inorganic nitrate particles in the form of AN or ANFO prills, is essentially a granular mass of slurry-bearing prills which has a higher bulk density and blasting energy than AN or ANFO prills alone. The sensitivity of this product is a function primarily of the prill component of the blend, the slurry component acting essentially as a density-enhancer. Therefore, the slurry employed in these blends need not be self-explosive, i.e., need not be in a sensitized condition per se. It requires no chemical sensitizer (e.g., none of the water-soluble or water-insoluble self-explosives or flake aluminum discussed previously), and no dispersed gas bubbles or voids, which are commonly used for sensitization. Whether or not the slurry is per se in a sensitized condition, the blend must contain at least 75 percent by weight of AN or ANFO prills which are normally effective when used alone as a blasting agent. Typically, these prills have a particle density of 1.35 to 1.52 g/cc, a prill void volume of 10.0 to 18.5%, and a poured density of 0.70 to 0.85 g/cc. The void volume of the prills constitutes the sensitizer for these blends.

As the content in the inorganic nitrate particles is lowered below about 75 percent, the composition of the invention takes on the characteristics of a thick slurry whose sensitivity is totally or partially dependent on the slurry component, which should per se be in a sensitized condition. Preferably, the inorganic nitrate particles are in the form of porous prills of the type described above for use in blends containing about 75 percent or more inorgnic particles. However, with certain blend ratios, i.e., those near the low end of the 40–75% nitrate particle range, the sensitivity derived from the slurry alone may be sufficient to produce a sensitized blend even if the nitrate particle component is not in the form of porous prills. The slurry used in the blends containing less than about 75 percent inorganic nitrate particles is a self-explosive by virtue of the presence of a chemical sensitizer, discussed previously, and void volume content, introduced either by mechanical agitation alone or by adding air-carrying solid material such as phenol-formaldehyde microballoons, glass microballoons, perlite, or fly ash to the slurry. If high-density prills are used, e.g., prills having a void volume less than 13%, oil-free prills preferably are used, and this fuel replaced by a particulate fuel, e.g., coal or gilsonite, incorporated in the slurry or co-blended.

In the blends of the invention the solid particulate nitrate component constitutes about from 40 to 95 percent, and the slurry component about from 60 to 5 percent, of the weight of the blend. It is in this range that the maximum mutual property benefits of the slurry and the nitrate particle component can be achieved inasmuch as the density of the blend increases as the slurry content increases up through about 60 percent, and tends to decrease thereafter. Therefore, maximized densities at minimum blend costs are achieved in this range, allowing more explosive to be loaded per hole with the optimization of blast results.

The weights of the solid particulate nitrate component and the slurry component constitute the total weight of the blend. For purposes of determining the ratios of these two components, the weight of the solid particulate nitrate component is the weight of the nitrate particles per se (e.g., AN prills) plus that of the fuel required to oxygen-balance the nitrate, e.g., the fuel oil in ANFO, or a solid carbonaceous fuel incorporated into the slurry or co-blended with the two components when fuel-free nitrate particles are employed.

The explosive compositions of this invention can be delivered into boreholes in packaged form, e.g., in bags or cartridges, and in bulk form. Those blends having sufficiently high slurry content as to more nearly resemble a slurry or water gel are more suitable for pumping. Augering is desirable for handling blends of lower slurry content. As is described in our co-pending U.S. application Ser. No. 710,543, filed concurrently herewith, blends of this invention containing no more than about 25 percent slurry by weight are among those which have been found to be adapted to be delivered into boreholes pneumatically, whereby the loaded product can have a loaded density which is dramatically higher than the blend's pour density. The high loaded density of the blend (slurry-bearing prills) in the borehole is of great benefit because of the higher bulk blasting energy (energy per unit of volume) associated therewith.

In the following illustrative examples, parts and percentages are by weight.

EXAMPLE 1

A slurry (water gel sol) of the following composition was prepared:

| Ingredient | Parts* | |
|---|---|---|
| AN | 16.7 | |
| SN | 34.2 | |
| MMAN | 35.1 | |
| Water | 9.3 | guar/water = 0.18 |
| Guar gum** | 1.7 | |
| Perlite | 1.0 | |
| Ethylene glycol | 2.0 | |

*Per 100 Parts of slurry
**0.6 part of Type "4603", a Celanese product, and 1.1 parts of "Galactasol 245-D", a Henkel product having a slower thickening action A mixture of the guar gum and 16% of the SN was mixed into a 50°-55° C. mixture of a 79% aqueous solution (liquor) of MMAN and the ethylene glycol in a mixing vessel, and mixing was continued for about 3 minutes until thickening was observed. Then the perlite, the remaining SN, and the AN (#2 grained) were mixed in sequentially. The viscosity of the resulting sol was 110 poise, as measured with a Brookfield viscometer at 25° C. using a No. 6 spindle at 20 rpm. Its density was 1.21 g/cc.

The explosive sol was packaged in a 12.7-cm-diameter, low-density-polyethylene bag and stored for about 24 hours to allow the completion of hydration. Thereafter, the sol was poured into a cement mixer and blended with sufficient ANFO prills to produce a 15/85 slurry/ANFO blend. The ANFO prills, before blending, had a density of 0.83 g/cc. The blended product, which had a pour density of 0.92 g/cc, was dry and granular, consisting of essentially free-flowing (pourable) discrete particles.

The blend was packaged in a 12.7-cm-diameter, low-density-polyethylene bag and stored at ambient temperature, (−18° C. to −6° C.) after which time it was loaded pneumatically into 3-meter-long steel pipes with a 50-kg-capacity Teledyne ANFO loader at an air pressure of 420 kPa through a 15-meter loading hose having a 1.9-cm inner diameter. The loader had a tank with a conical bottom having a 45° conical angle. The loaded densities and detonation velocities (initiated with a No. 12 electric blasting cap) were as follows:

| | 4.1-cm-diam. Pipe | | 3.5-cm-diam. Pipe | |
|---|---|---|---|---|
| Blend Age | Loaded Density g/cc | Detonation Velocity m/sec | Loaded Density g/cc | Detonation Velocity m/sec |
| 1 day | 0.98 | 3097 | 1.02 | 3097 |
| 3 weeks | 1.10 | 3300 | 1.06 | 2870 |
| 5 weeks | 1.07 | 3848 | 1.12 | 3298 |

When the blended product was loaded in the same manner in 4.4-cm-diameter holes in an underground mine face over a period of 6 to 15 days after blending, the average loaded densities of 27–36 holes were 1.03, 1.14, 1.14, 1.11, 1.17, 1.14, and 1.15 g/cc (each value represents the average of the holes loaded on a given day). The fragmentation obtained equaled, and in most instances surpassed, that usually achieved with ANFO alone.

The loaded density usually achieved when the same ANFO (pour density 0.83 g/cc) used to make the above blend is loaded into 4.1-cm-diameter pipes under the above loading conditions is about 0.95 g/cc. This is a density increase of only about 14%, whereas the density increase achieved when the slurry-bearing prills of the invention were loaded under approximately the same conditions was as high as 27%.

A blend prepared as described above was stored for 12 weeks and thereafter loaded into a 5-cm-diameter pipe under the above-described conditions. The product loaded to a density of 1.14 g/cc, and detonated at 3735 m/sec.

EXAMPLE 2

Four different slurries were made by combining an aqueous solution (liquor) of about 73% by weight of monomethylamine nitrate (MMAN), at a temperature of 80° C., in a mixing vessel with an aqueous solution (liquor) of about 75% by weight of ammonium nitrate (AN), also at 80° C. The pH of the combined hot liquors was adjusted to approximately 4. Thereafter, solid AN and a premixed combination of sodium nitrate (SN) and guar gum were added sequentially, and mixing continued for 7 minutes until thickening was observed.

One hundred parts of the resulting slurry explosives contained the following:

| Ingredient | Parts Slurry No.(1) 2-A* | 2-B** | 2-C*** | 2-D*** |
|---|---|---|---|---|
| AN | 26.5 | 44.9 | 30.9 | 31.4 |
| SN | 14.5 | 8.0 | 9.6 | 9.7 |
| MMAN | 41.0 | 29.9 | 40.4 | 40.8 |
| Water | 16.4 | 14.2 | 14.9 | 15.1 |
| Guar gum | 0.2 | 1.2 | 1.2 | 1.0 |
| Viscosity (poise) | 100 | 1000 | 1000 | 600 |
| Density (g/cc) | 1.35 | 1.33 | 1.33 | 1.38 |

*Contained 0.5 part of polyacrylamide, added with the SN and guar gum; 0.3 part ethylene glycol, added with the liquors; and an antimonyl compound (Celanese) and Ti ammonium lactate as crosslinkers.
**Contained 0.8 part oil, in the mixing vessel with the liquors.
***Contained 2.0 parts ethylene glycol, added with the liquors.
(1)Slurries 2-A, 2-B, and 2-C contained 0.6, 1.0, and 1.0 part glass microballoons, respectively, added after the solid AN.

The above slurry explosives were blended with ANFO prills in a mixing vessel in three different ratios. The prills, before blending had a density of 0.8 g/cc. Blends were made by mixing for 10 minutes. In some of the blending operations a crosslinker for the guar gum was added slowly as a solution to the blend after a 7-minute mixing time, and the crosslinker-containing blend was stirred for 3 minutes.

The stability of the blends was evaluated on the basis of visible oil separation from the prills taken as an indicator of prill attack by water from the slurry. The results (see table below) show that a slurry (2-A) which contained nearly 17% water showed little evidence of oil separation after 6 days in a 15/85 blend (B-1) with ANFO, whereas gross oil separation was encountered with the same slurry in a 50/50 blend (B-2). Because gross oil separation after a short period of time could be an indicator of impending product failure, it is preferred that the use of slurries such as Slurry 2-A be confined to blends of lower slurry content (e.g., Blend B-1), where oil separation is only minor.

The tabulated results also show that slurries containing less water (Slurries 2-B and 2-C) show only a trace of oil separation after 6 days even in blends of high slurry content (Blends B-7 and B-9), evidence of a high degree of stability of these blends. Blends (B-3 through B-6, B-8, B-10, and B-11) in which the slurry's thickener became crosslinked after blending, even with slurries containing as much as about 15% water, showed no oil separation whatever after 6 days, and post-crosslinked systems therefore are preferred when maximum stability is required.

| Blend No. | Slurry No. | Slurry/ ANFO (by wt.) | Crosslinker*** | Density g/cc | Oil Separation After 6 Days |
|---|---|---|---|---|---|
| B-1 | 2-A | 15/85 | Pre-crosslinked | 1.13* | minor |
| B-2 | 2-A | 50/50 | Pre-crosslinked | 0.98 (as made) 1.42 (after 2 days)** | gross |
| B-3 | 2-B | 15/85 | $Na_2Cr_2O_7$ PAT | 1.10 | none |
| B-4 | 2-B | 15/85 | Potassium pyro-antimonate | 1.10 | none |
| B-5 | 2-B | 30/70 | $Na_2Cr_2O_7$ PAT | 1.25 | none |
| B-6 | 2-B | 30/70 | Potassium pyro-antimonate | 1.29 | none |
| B-7 | 2-B | 50/50 | none | 1.39 | trace |
| B-8 | 2-B | 50/50 | $Na_2Cr_2O_7$ PAT | 1.39 | none |
| B-9 | 2-C | 50/50 | none | 1.28 | trace |
| B-10 | 2-C | 50/50 | $Na_2Cr_2O_7$ PAT | 1.26 | none |
| B-11 | 2-D | 50/50 | Potassium pyro-antimonate | 1.24 | none |

*1.25–1.35 after pneumatic loading
**Density increase with time believed to be due to release of entrapped air
***PAT = potassium antimony tartrate

EXAMPLE 3

The following slurry explosive was prepared by the procedure described in Example 2:

| Ingredient | Parts |
|---|---|
| AN | 26.7 |
| SN | 14.6 |
| MMAN | 40.9 |
| Water | 15.6 |
| Guar gum | 1.0 |
| Polyacrylamide | 0.2 |
| Polypropylene glycol* | 0.3 |
| Glass microballoons** | 0.6 |
| Crosslinkers | 0.07 |

*An anti-foaming agent
**3M B23-500 glass bubbles

The slurry explosive was blended in a mixing vessel for 10 minutes with AN prills and ground rubber in the weight ratios of 37.5/58.6/3.9 slurry/AN/rubber. The density of the blend was 1.16 g/cc.

The blend's explosive energy immediately after blending and about 1.5 months after blending was evaluated by means of a lead block compression test. On the day of blending, the compression was 6.5 cm. Forty-seven days later, it was 5.7 cm, still well above the 4.4-cm value considered acceptable for this test.

We claim:

1. A storage-stable explosive composition comprising a sensitized blend formed by combining inorganic nitrate particles and an aqueous slurry comprising a thickened aqueous solution of an inorganic oxidizing salt, said slurry's water content and viscosity being restricted so as to make said slurry at once flowable and water-retentive, said slurry constituting about from 5 to 60 percent, and said nitrate particles about from 95 to 40 percent, of said blend by weight.

2. An explosive composition of claim 1 wherein said inorganic nitrate particles are ammonium nitrate (AN) prills, ANFO prills, or a combination thereof, and said inorganic oxidizing salt in said thickened aqueous solution comprises AN alone or in combination with sodium nitrate.

3. An explosive composition of claim 2 wherein said particles are AN prills, and said blend contains sufficient fuel to oxygen-balance said prills.

4. An explosive composition of claim 3 wherein said blend contains a particulate solid carbonaceous fuel.

5. An explosive composition of claim 2 wherein said aqueous slurry contains up to about 25 percent of water by weight, and a thickener in an amount sufficient to impart to said slurry a viscosity in the range of about from 80 to 3000 poise.

6. An explosive composition of claim 5 wherein said thickener is at least one member of the group consisting of galactomannans.

7. An explosive composition of claim 6 wherein at least a part of said thickener is hydroxypropyl guar gum, and oil is a dispersed phase in said thickened aqueous solution.

8. An explosive composition of claim 5 wherein said blend is a granular mass of slurry-bearing prills containing up to about 25 percent of said slurry by weight.

9. An explosive composition of claim 8 wherein said blend is sensitized by the voids in said prills.

10. An explosive composition of claim 8 wherein said thickener in said blended slurry is crosslinked.

11. An explosive composition of claim 9 wherein said aqueous slurry contains a dissolved nitrogen-base salt of an inorganic oxidizing acid and up to about 17 percent of water by weight.

12. An explosive composition of claim 11 wherein said nitrogen-base salt is present in slurry-sensitizing amounts.

13. An explosive composition of claim 5 wherein said blend contains about from 25 to 60 percent of said slurry by weight, up to about 17 percent of water by weight, and a sensitizing amount of a dissolved nitrogen-base salt of an inorganic oxidizing acid.

14. An explosive composition of claim 13 wherein said thickener in said blended slurry is crosslinked.

15. In a method of preparing an explosive composition by mixing inorganic nitrate particles with an aqueous slurry comprising a guar-thickened aqueous solution of an inorganic oxidizing salt to form a sensitized blend of said particles and said slurry, the improvement comprising crosslinking said guar after said mixing, whereby a storage-stable blend is formed.

16. A method of claim 15 wherein said slurry's water content is up to about 25 percent by weight.

* * * * *